US010134537B2

(12) United States Patent
Fonseca et al.

(10) Patent No.: US 10,134,537 B2
(45) Date of Patent: Nov. 20, 2018

(54) FILTER ASSEMBLY FOR A CIRCUIT BREAKER ARC CHAMBER

(71) Applicant: ABB Schweiz AG, Baden (CH)

(72) Inventors: Shawn Couceiro Fonseca, Newington, CT (US); Dhirendra Tiwari, Farmington, CT (US); Hardik Upadhyay, Meriden, CT (US)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/044,353

(22) Filed: Feb. 16, 2016

(65) Prior Publication Data

US 2016/0240337 A1 Aug. 18, 2016

Related U.S. Application Data

(60) Provisional application No. 62/117,265, filed on Feb. 17, 2015.

(51) Int. Cl.
*H01H 9/34* (2006.01)
*H01H 73/18* (2006.01)

(52) U.S. Cl.
CPC ..... *H01H 9/342* (2013.01); *H01H 73/18* (2013.01)

(58) Field of Classification Search
CPC .. H01H 2009/365; H01H 9/342; H01H 9/302; H01H 9/362
See application file for complete search history.

(56) References Cited

U.S. PATENT DOCUMENTS

| | | | | |
|---|---|---|---|---|
| 3,621,169 | A * | 11/1971 | Heft | H01H 33/58 218/152 |
| 3,997,746 | A | 12/1976 | Harper et al. | |
| 4,733,032 | A | 3/1988 | Pardini | |
| 4,748,301 | A | 5/1988 | Goldman et al. | |
| 5,889,249 | A * | 3/1999 | Rival | H01H 9/342 218/149 |
| 6,291,788 | B1 | 9/2001 | Doughty et al. | |
| 6,762,389 | B1 * | 7/2004 | Crooks | H01H 9/342 218/157 |
| 7,674,996 | B2 * | 3/2010 | Shea | H01H 9/302 218/149 |
| 7,705,263 | B2 * | 4/2010 | Rane | H01H 9/34 218/149 |
| 8,519,287 | B2 | 8/2013 | Raabe et al. | |
| 2003/0048586 | A1 * | 3/2003 | Faber | H01H 9/342 361/1 |

(Continued)

FOREIGN PATENT DOCUMENTS

| | | |
|---|---|---|
| CN | 202363758 U | 8/2012 |
| CN | 204391517 U | 6/2015 |

(Continued)

OTHER PUBLICATIONS

PCT Search Report and Written Opinion issued in connection with corresponding PCT Application No. PCT/PCT/US2016/18235 dated Aug. 10, 2016, Nov. 10, 2016.

*Primary Examiner* — Truc Nguyen
(74) *Attorney, Agent, or Firm* — Barnes & Thornburg LLP

(57) ABSTRACT

A filter assembly for a circuit breaker arc chamber includes a coarse filter layer defining an outlet layer, having an upstream side and a downstream side opposite the upstream side, and a fine filter layer defining an inlet layer, disposed on the upstream side of the coarse filter layer.

19 Claims, 3 Drawing Sheets

(56) References Cited

U.S. PATENT DOCUMENTS

| | | | | |
|---|---|---|---|---|
| 2003/0062341 | A1 | 4/2003 | Bach et al. | |
| 2003/0201853 | A1* | 10/2003 | Charles | H01H 1/2058 335/16 |
| 2005/0012575 | A1* | 1/2005 | Huang | H01H 83/04 335/18 |
| 2008/0067153 | A1* | 3/2008 | Pollitt | H01H 9/342 218/154 |
| 2012/0091820 | A1 | 4/2012 | Campanella et al. | |
| 2015/0168014 | A1 | 6/2015 | Wu et al. | |
| 2015/0179364 | A1 | 6/2015 | Thomas | |
| 2015/0270075 | A1* | 9/2015 | Das | H01H 9/342 218/149 |
| 2017/0278653 | A1* | 9/2017 | Rival | H01H 33/08 |

FOREIGN PATENT DOCUMENTS

| | | | |
|---|---|---|---|
| EP | 0022708 | A1 | 1/1981 |
| EP | 0437151 | A1 | 7/1991 |
| EP | 1298687 | A2 | 4/2003 |
| EP | 1939904 | A2 | 7/2008 |
| JP | 5583121 | A | 6/1980 |
| JP | 0485552 | U | 7/1992 |

* cited by examiner

FILTER ASSEMBLY FOR A CIRCUIT BREAKER ARC CHAMBER

BACKGROUND OF THE INVENTION

The subject matter disclosed herein relates to the art of circuit breakers and, more particularly, to a filter assembly for a circuit breaker arc chamber.

Circuit breakers typically include a stationary contact and a movable contact. A switch assembly shifts or pivots the movable contact against the stationary contact to complete an electrical circuit. The switch assembly may also be operated to disengage the movable contact from the stationary contact to interrupt the electrical circuit. In addition to manual operation, circuit breakers include systems to open the electrical connection in the event of an over current condition. More specifically, circuit breakers are designed to interrupt current flow in the event that current levels exceed a predetermined rating. Often times when interrupting the electrical circuit due to an over current condition, breaking a connection between the movable contact and the stationary contact results in an arc. Many circuit breakers include an arc chamber that captures the arc.

Conventional arc chambers may include a filter to capture debris and gasses associated with arcing and degradation of the movable contact and/or the stationary contact that may occur. In conventional filters, a plurality of superposed wire cloths have progressive mesh openings; the cloth presenting the largest mesh openings is disposed to be the first cloth (i.e., upstream) being passed through by the gases, while the cloth presenting the smallest mesh openings, is disposed to be the last cloth (i.e., downstream) being passed through by the gases.

However, in some circuit breakers, the arcing generated when interrupting relatively high levels of current result in very high internal pressures generated within the circuit breaker housing. While internal pressure may help to extinguish an arc, however if the pressure is too high, damage to the integrity of the housing may result. Using prior art circuit breakers having conventional progressive arc filters can in certain instances generate undesired high internal pressures in the arc chamber, and result in damage to the wire mesh of the smallest mesh filter. Accordingly, there is a need for an improved arc filter assembly for a circuit breaker having an optimized screen or filter that cools the high temperature gasses, reduces gas and particulate egress from the circuit breaker housing, while reducing internal pressures during arcing conditions, and consequent damage to the filter.

BRIEF DESCRIPTION OF THE INVENTION

According to an aspect of an exemplary embodiment, a circuit breaker includes a stationary contact, a movable contact, and an arc chamber arranged adjacent at least one of the stationary contact and the movable contact. The arc chamber includes a filter assembly provided with a coarse filter layer defining an outlet layer, having an upstream side and a downstream side opposite the upstream side; and a fine filter layer defining an inlet layer, disposed on the upstream side of the coarse filter layer.

These and other advantages and features will become more apparent from the following description taken in conjunction with the drawings.

BRIEF DESCRIPTION OF DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
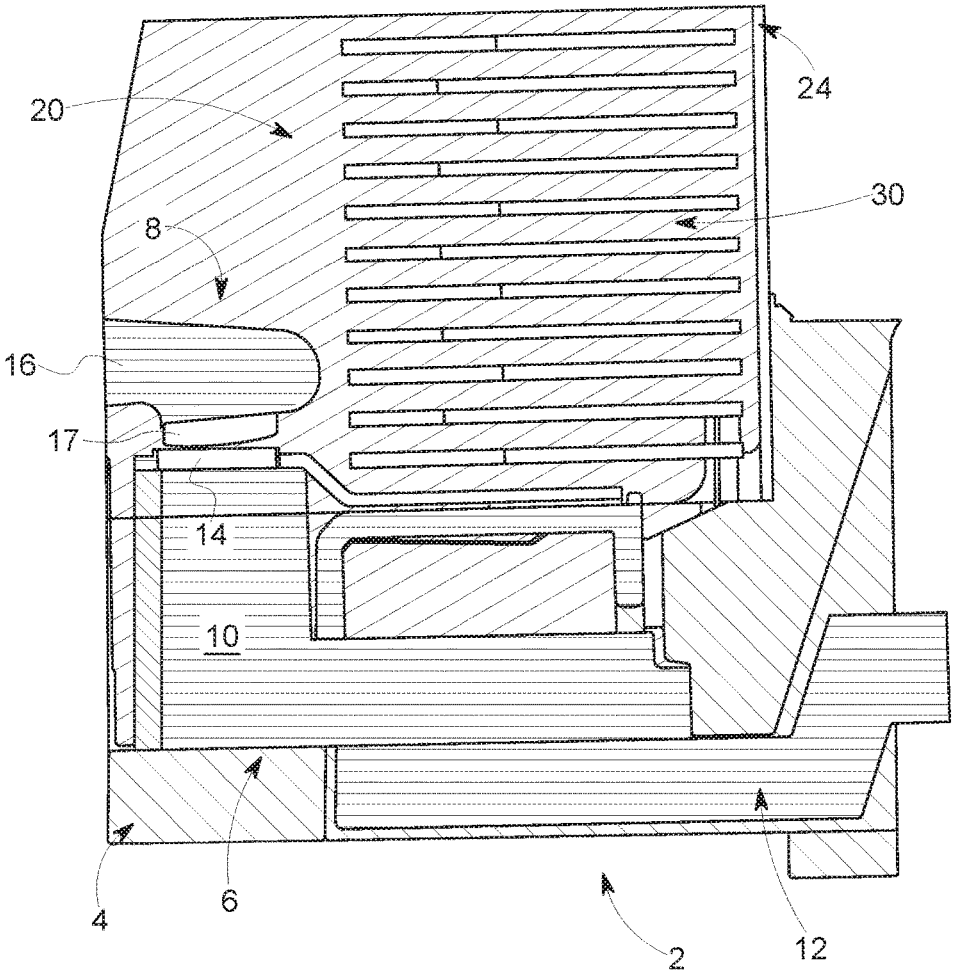
FIG. 1 depicts a circuit breaker including an arc chamber having a filter assembly, in accordance with an exemplary embodiment.

A circuit breaker, in accordance with an exemplary embodiment, is indicated generally at 2, in FIG. 1. Circuit breaker 2 includes a housing 4 that encloses a first or stationary contact assembly 6 and a second or movable contact assembly 8. Stationary contact assembly 6 includes a base member 10 electrically connected with a lug or connection strap 12. Base member 10 is also shown to support a stationary contact 14. Movable contact assembly 8 includes a movable or pivoting arm 16 that supports a movable contact 17. Movable contact 17 selectively engages with stationary contact 14 to establish an electrical circuit. In the event of an over current condition, movable arm 16 is shifted causing movable contact 17 to disengage from stationary contact 14, thereby opening the electrical circuit. An arc chamber 20 is positioned adjacent base member 10 and arranged as a chute to collect and guide any arcing gasses that may flow during an arcing event when movable contact 17 is separated from engagement with stationary contact 14, and to guide the arcing gases to exit the circuit breaker 2.

In accordance with an exemplary embodiment, arc chamber 20 includes a filter assembly 24 disposed in flow communication with the contacts 14, 17 and arranged to receive a flow of arcing gasses during an arcing event. The filter assembly 24 include a plurality of filter layers 30 which, in accordance with an aspect of an exemplary embodiment, may be secured in a frame 31.

Each filter layer 30 may be formed using a woven wire mesh. For example, in an embodiment, each filter layer 30 may be formed by a criss-crossing of straight wires spaced apart from and parallel to one another with tightly joined undulated wires that extend substantially perpendicular to the straight wires, and pass alternately over and under at least one of the successive straight wires. It will be appreciated that the wire size and shape used to form the wire mesh may be selected from any desired wire size and shape that provides the desired mesh openings of the filter assembly 24. In other embodiments, other weave patterns may be used to obtain any desired size and shape of filter openings. For example, by selecting larger or smaller wire gauges to weave the filter layers to a desired coarseness or fineness (i.e. the relative size of the mesh openings), an air permeability through the filter assembly may be adjusted to desired levels.

Filter assembly 24 also functions to filter, deionize, and reduce the temperature of the gasses exiting the circuit breaker during an arcing event. Filter layers 30 are configured to entrap any debris that may be carried by the arc, deionize and cool gases that may occur, and adjust a back pressure in arc chamber 20 to promote arc capture. In the exemplary embodiment shown in FIGS. 2 and 3, filter assembly 24 includes an upstream or inlet filter layer 32, a downstream or outlet filter layer 34, and a plurality of intermediate filter layers 36-40. In various embodiments, the downstream outlet filter layer 34, and the intermediate filter layers 36-40 additionally serve to reinforce or strengthen the upstream inlet filter layer 32

In accordance with an aspect of an exemplary embodiment, upstream filter layer 32 takes the form of a selectively positionable fine filter layer 42 having a plurality of fine filter openings 43. At this point it should be understood that the phrase "selectively positionable" should be understood to mean that fine filter layer 42 may be arranged at any position in filter assembly 24 depending upon desired filtering, deionization, pressure, and strength parameters of the arc chamber 20. Moreover, it should also be understood that the term "fine filter" should be understood to mean a filter having smaller mesh area openings than a coarse filter, or intermediate filter. Likewise, it should be understood that the term "coarse filter" should be understood to mean a filter having larger mesh area openings than a fine filter. Similarly, it should also be understood that the term "intermediate filter" should be understood to mean a filter having larger mesh area openings than a fine filter, and either smaller mesh area openings, or larger mesh area openings, than a coarse filter. Once positioned, fine filter layer 42 may be joined with, or bonded to, intermediate filter layers 36-40 and downstream coarse filter layer 34 such that filter assembly 24 may be fully integrated. Of course, it should also be understood that filter assembly 24 may also be formed of separate layers that are not bonded.

In further accordance with the exemplary embodiment, downstream filter layer 34 is defined by a coarse filter layer 46 having an upstream side 47, a downstream side 48, and a plurality of coarse filter openings 50 that are larger than fine filter openings 43. Fine filter layer 42 is positioned upstream of upstream side 47 of the coarse filter layer 46. In the exemplary embodiment shown, fine filter layer 42, e.g., the layer having fine filter openings that are smaller than any other layer in filter assembly 24, is arranged as upstream or inlet filter layer 32. Thus, in accordance with an embodiment, the coarse filter layer 46 defines the outlet layer 34, having an upstream side 47 and a downstream side opposite the upstream side 48, and the fine filter layer 42 defines the inlet layer 32 which is disposed on the upstream side 47 of the coarse filter layer.

While conventional filters have previously placed filtration layers to perform filtration gradually through the filter, (i.e., by using increasingly finer filtration through the filter) thus allowing only progressively smaller particles to flow to the next filter layer, the embodiments described herein are not so arranged. By placing the fine filtration layer 42 at the upstream side of the coarse filter layer 46, a filtration of the finest particles occurs earlier in the filter assembly and the gasses that pass through the fine filter layer 42 can be dispersed and diffused through the remaining downstream filter layers. In an embodiment, the desired position of the fine filtration layer 32, relative to the intermediate filter layers 36-40, are determined based a desired air permeability of the filter 24, as well as on factors dependent on the particular circuit breaker characteristics, such as the desired backpressure, pressure drop, arcing gas temperature, and the nature of the particulate matter striking the upstream surface of the filter assembly 24.

Accordingly, it should be appreciated that in various embodiments, it is contemplated that the fine filter layer 42 may be positioned as the upstream or inlet filter layer 32, or the intermediate filter layers 36-40, or both, but the fine filter layer is not positioned as the downstream filter layer 34. In this way, the fine filter layer 42 is advantageously mechanically supported or reinforced either by the downstream intermediate filter layers 36-40, the coarse filter layer 46, or both, to thus prevent deformation of the upstream fine filter layer 42 due to the high pressures of the gasses and particulate matter flowing downstream during an arcing event.

It is contemplated that in various embodiments, the order of the filter layers of filter assembly 24 can be arranged, with respect to the arcing gas flow from upstream to downstream within the circuit breaker housing, to advantageously form a symmetrical configuration of filtration layers. Such a symmetrical configuration of filter assembly 24 will simplify handling and enable easier assembly of the filter within the circuit breaker. For example, an exemplary embodiment may be arranged to include, referencing from upstream to downstream, a coarse filter layer 46, then an intermediate filter layer 44, then a fine filter layer 42, then an intermediate filter layer 44, then a coarse filter layer 46. In such a filter assembly 24, the filter can be installed in the circuit breaker housing without need of first determining the inlet side 32 or outlet side 34 of the filter for proper orientation within the circuit breaker.

In further accordance with an aspect of an exemplary embodiment, each intermediate filter layer 36-40 includes a corresponding plurality of intermediate openings 54-58. Intermediate openings 54-58 may be larger than or smaller than coarse filter openings 50. Further, the size of each of the plurality of intermediate openings 54-58 may vary for each intermediate filter layer 36-40. Thus, a flow path through filter assembly 24 may be variable depending upon the disposition of intermediate filter layers 36-40, fine filter layer 42 and coarse filter layer 46. It should also be understood, that an intermediate layer shown in FIGS. 2 and 3 may also serve as an inlet layer or an outlet layer depending upon a desired configuration of filter assembly 24.

Figure 2:
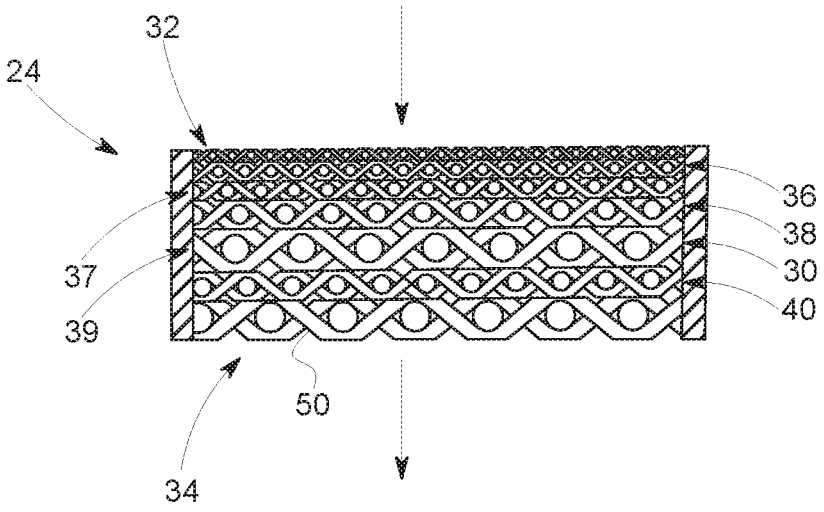
FIG. 2 depicts a side view of the filter assembly of FIG. 1.
Figure 3:
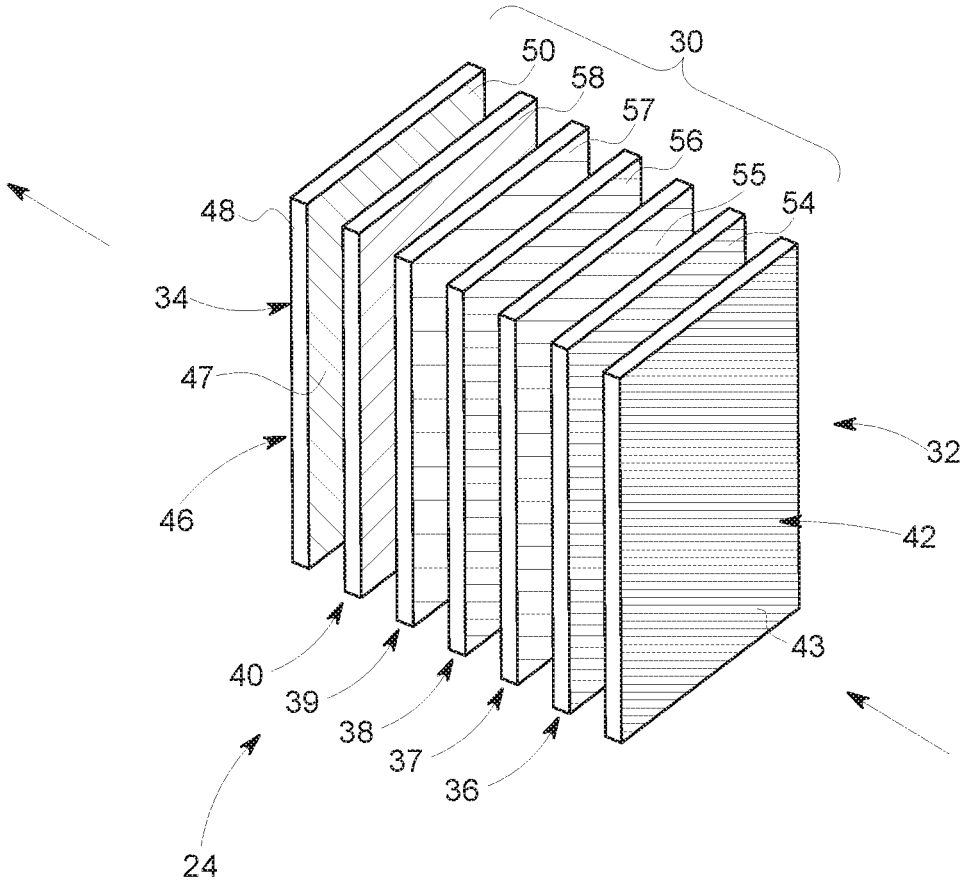
FIG. 3 depicts an exploded view of the filter assembly of FIG. 2.

In the exemplary embodiment shown in FIGS. 2 and 3, wherein a flow from upstream to downstream is generally indicated by arrows, filter assembly 24 includes an upstream or inlet filter layer 32, a downstream or outlet filter layer 34, and a plurality of intermediate filter layers 36-40. In such an embodiment, for example, the upstream or inlet filter layer 32 comprises a fine filter layer 42 that may be formed of stainless steel wires having a diameter of 0.0055 in. arranged in a square weave pattern to define the fine filter openings 43 totaling 31% of the of the upstream facing surface area of the fine filter layer 42. An outlet filter layer 34 comprising a coarse filter layer 46 is disposed downstream of the inlet filter layer 32. The coarse filter layer 46 may be formed of stainless steel wires having a diameter of 0.023 in. arranged in a square wave pattern to define the coarse filter openings 50 totaling 56% of the upstream facing surface area of the coarse filter layer 46. Interposed between the inlet filter layer 32 and outlet filter layer 34 may be a plurality of intermediate filter layers 36-40. These intermediate filter layers 36-40 may be formed of stainless steel wires having diameters of 0.012 in., 0.016 in., 0.023 in, 0.016 in., and 0.023 in., respectively, arranged in a square weave pattern to define filter openings totaling 40%, 46%, 39%, 46%, and 39%, respectively, of the of the upstream facing surface area of the respective intermediate filter layers 36-40.

Figure 4:
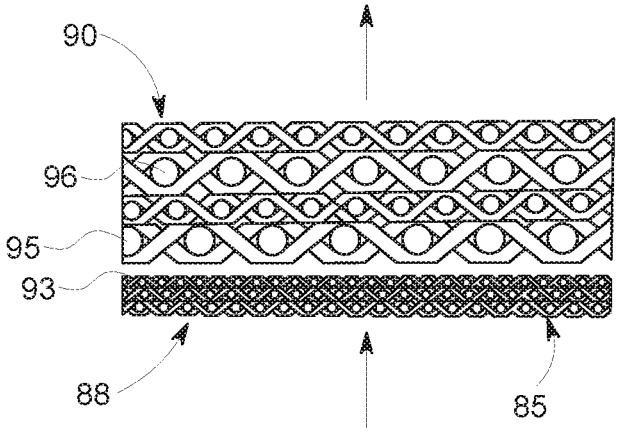
FIG. 4 depicts a side view of a filter assembly, in accordance with another aspect of an exemplary embodiment.

In another example, with reference to FIG. 4, a filter assembly 85, in accordance with another aspect of an exemplary embodiment, is shown to include an upstream filter layer 88 and a downstream filter layer 90. A fine filter layer 93 is interposed between upstream filter layer 88 and downstream filter layer 90. A plurality of coarse layers, 95 and 96 are also interposed between upstream filter layer 88 and downstream filter layer 90. In this embodiment, fine filter layer 93, e.g., a layer having fine filter openings that are smaller than any other filter layer in filter assembly 85, serves as an intermediate filter layer.

In further accordance with an exemplary embodiment, each filter layer 36-40, 42 and 46 is formed from a mesh screen (not separately labeled). Each mesh screen may constitute a woven mesh screen or a welded mesh screen. Further, one or more of filter layers 36-40, 42 and 46 may be formed from metallic mesh screens while others of layers 36-40, 42 and 46 may be formed from non-metallic mesh screens. Of course, it should also be understood that each of layers 36-40, 42 and 46 may be formed from a metallic mesh screen and, conversely, each of layers 36-40, 42 and 46 may be formed from non-metallic mesh screens. Further, one or more of the metallic mesh screens may constitute magnetic mesh screens. In still further accordance with an exemplary embodiment, an opening geometry of the mesh screens may vary and could include one or more of rectangular openings, square openings, circular openings, elliptical openings, and/or triangular openings.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A circuit breaker comprising:

a stationary contact;

a movable contact; and an arc chamber disposed adjacent at least one of the stationary contact and the movable contact, and arranged to guide a flow of arcing gasses formed during an arcing event to exit the circuit breaker, the are chamber including a filter assembly comprising:

a coarse filter layer defining an outlet layer, having an upstream side with respect to the flow of arcing gasses, and a downstream side opposite the upstream side; and a fine filter layer defining an inlet layer, disposed on the upstream side of the coarse filter layer.

2. The circuit breaker according to claim 1, further comprising: one or more intermediate layers positioned between the fine filter layer and the coarse filter layer.

3. The circuit breaker according to claim 1, wherein each of the coarse filter layer and the fine filter layer are formed from mesh screens defining a plurality of openings therethrough.

4. The circuit breaker according to claim 3, wherein the mesh screen comprises a metallic mesh.

5. The circuit breaker according to claim 4, wherein the metallic mesh is formed from a magnetic steel.

6. The circuit breaker according to claim 1, wherein the filter assembly includes an upstream filter layer, a downstream filter layer, and a plurality of intermediate filter layers, wherein the coarse filter layer and the fine filter layer form two of the plurality of intermediate filter layers.

7. The circuit breaker according to claim 1, wherein the filter assembly further comprises a plurality of intermediate filter layers, disposed between the inlet layer and the outlet layer.

8. The circuit breaker according to claim 7, wherein the upstream filter layer defines a first plurality of openings therethrough, the downstream filter layer defines a second plurality of openings therethrough, and each of the plurality of intermediate filter layers define a respective plurality of intermediate openings, wherein each of the first plurality of openings is smaller than each of the second plurality of openings and each of the intermediate openings.

9. The circuit breaker according to claim 7, wherein the upstream filter layer defines a first plurality of openings, the downstream filter layer defines a second plurality of openings, and each of the plurality of intermediate filter layers define a respective plurality of intermediate openings, wherein the each of the plurality of intermediate openings of one of the plurality of intermediate layers is smaller than each of the first plurality of openings, each of the second plurality of openings, and the intermediate openings of each of the other intermediate layers.

10. The circuit breaker of claim 1, further comprising a second fine filter layer, disposed on the downstream side of the coarse filter layer.

11. The circuit breaker of claim 10, wherein the fine filter layer, the coarse filter layer, and the second fine filter layer are symmetrically arranged, with respect to the arcing gas flow from upstream to downstream, within the circuit breaker housing.

12. A circuit breaker comprising:

a housing enclosing a movable contact and a stationary contact, the moveable contact being selectively engageable with the stationary contact; and an arc chamber enclosed within the housing adjacent the stationary contact, and arranged to guide a flow of arcing gasses formed during an arcing event to exit the circuit breaker, the arc chamber including a filter assembly comprising a plurality of filter layers including:

a first woven wire mesh filter defining a fine filter; and a second woven wire mesh filter defining a coarse filter;

wherein the first woven wire mesh filter is nearer the stationary contact than the first woven wire mesh filter.

13. The circuit breaker of claim 12, wherein the plurality of filter layers comprises additional woven wire mesh filters.

14. The circuit breaker of claim 12, wherein the plurality of filter layers have an increasingly coarse filtration with respect to the flow of arcing gasses.

15. The circuit breaker of claim 12, wherein the plurality of filter layers comprises an intermediate wire mesh filter disposed between the first and second wire mesh filters.

16. The circuit breaker of claim 12, wherein the plurality of filters layers are bonded together.

17. The circuit breaker of claim 12, wherein the first woven wire mesh filter is selectively positionable within the plurality of filter layers with respect to the flow of arcing gasses.

18. The circuit breaker of claim 15, wherein the intermediate wire mesh filter mechanically supports the first wire mesh filter.

19. The circuit breaker of claim 12, wherein an order of the filter layers of the filter assembly is symmetrically arranged with respect to the flow of arcing gasses.

* * * * *